US008665183B2

(12) United States Patent
Liu et al.

(10) Patent No.: US 8,665,183 B2
(45) Date of Patent: Mar. 4, 2014

(54) PIXEL DRIVING METHOD OF ACTIVE MATRIX ORGANIC LIGHT EMITTING DIODE DISPLAY

(75) Inventors: Chun-Yen Liu, Hsin-Chu (TW); Yuan-Chun Wu, Hsin-Chu (TW)

(73) Assignee: Au Optronics Corp., Hsinchu (TW)

( * ) Notice: Subject to any disclaimer, the term of this patent is extended or adjusted under 35 U.S.C. 154(b) by 594 days.

(21) Appl. No.: 12/905,482

(22) Filed: Oct. 15, 2010

(65) Prior Publication Data

US 2011/0090137 A1 Apr. 21, 2011

(30) Foreign Application Priority Data

Oct. 16, 2009 (TW) ..... 98135118 A

(51) Int. Cl.
*G09G 3/30* (2006.01)

(52) U.S. Cl.
USPC ..... 345/76; 345/77

(58) Field of Classification Search
USPC ..... 345/76–83; 315/169.3
See application file for complete search history.

(56) References Cited

U.S. PATENT DOCUMENTS

| | | | | |
|---|---|---|---|---|
| 7,545,351 | B2 | 6/2009 | Shin | |
| 2003/0090481 | A1* | 5/2003 | Kimura | 345/211 |
| 2005/0270258 | A1* | 12/2005 | Shin | 345/76 |
| 2006/0139259 | A1* | 6/2006 | Choi et al. | 345/76 |
| 2006/0221015 | A1* | 10/2006 | Shirasaki et al. | 345/77 |
| 2007/0242016 | A1* | 10/2007 | Choi | 345/92 |
| 2008/0074413 | A1* | 3/2008 | Ogura | 345/212 |
| 2008/0150847 | A1* | 6/2008 | Kim et al. | 345/82 |
| 2008/0211397 | A1* | 9/2008 | Choi | 313/504 |
| 2009/0027369 | A1* | 1/2009 | Lee et al. | 345/204 |
| 2009/0167648 | A1* | 7/2009 | Jeon et al. | 345/76 |
| 2009/0213046 | A1* | 8/2009 | Nam | 345/76 |
| 2009/0309816 | A1* | 12/2009 | Choi | 345/76 |
| 2011/0050659 | A1* | 3/2011 | Tsai et al. | 345/205 |

FOREIGN PATENT DOCUMENTS

CN 200910134853.3 10/2010

* cited by examiner

*Primary Examiner* — Alexander Eisen
*Assistant Examiner* — Nelson Lam
(74) *Attorney, Agent, or Firm* — WPAT, PC; Justin King

(57) ABSTRACT

An exemplary pixel circuit includes an OLED, a storage capacitor, a driving transistor and first through fourth switching transistors. The driving transistor is for driving the OLED at a predetermined brightness. The first source/drain electrode of the driving transistor is coupled to a terminal of the storage capacitor, the second source/drain electrode is coupled to the OLED, and the gate electrode is coupled to receive a data voltage through the first switching transistor. Gate-on voltages of the first and second switching transistors are in opposite phases to each other, and the first and second switching transistors are controlled by the same control signal. Likewise, gate-on voltages of the third and fourth switching transistors are in opposite phases to each other, and the third and fourth switching transistors are controlled by the same control signal. A pixel driving method is also disclosed.

7 Claims, 5 Drawing Sheets

PIXEL DRIVING METHOD OF ACTIVE MATRIX ORGANIC LIGHT EMITTING DIODE DISPLAY

BACKGROUND

1. Technical Field

The present invention generally relates to display technology of organic light emitting diode (OLED) and, particularly to a pixel circuit and a pixel driving method.

2. Description of the Related Art

Usually, in an active matrix organic light emitting diode (OLED) display, a pixel is configured with transistors and a storage capacitor operatively to store charges and thereby control a brightness of OLED. Refer to FIG. 1, which shows a schematic diagram of a traditional pixel circuit. The pixel circuit 10 has a two-transistor and one-capacitor (2T1C) structure. The pixel circuit 10 includes a P-channel driving transistor M1, a P-channel switching transistor Ms, a storage capacitor Cst and an OLED 16. Two terminals of the storage capacitor Cst are respectively electrically connected to the gate electrode and the source electrode of the driving transistor M1. The source electrode of the driving transistor M1 is electrically coupled to a power supply voltage VDD. The drain electrode of the driving transistor M1 is electrically coupled to the anode of the OLED 16. The cathode of the OLED 16 is electrically coupled to another power supply voltage VSS. The gate electrode of the driving transistor M1 is electrically coupled to a data line DL through the switching transistor Ms and for receiving a data voltage Vdata from the data line DL. The gate electrode of the switching transistor Ms is electrically coupled to a scanning line SCAN, so that the on-off states of the switching transistor Ms can be controlled by the scanning line SCAN. Herein, the brightness of the OLED 16 can be changed by providing different data voltages Vdata.

However, for each pixel circuit of the active matrix OLED display, due to the impact caused by a threshold voltage shift of the transistors related to their manufacture process, material attenuation and/or operating time of the OLED, a pixel current of the pixel circuit must be compensated by adjusting the data voltage Vdata for getting a better brightness, so as to achieve good display effect. Therefore, for the purpose of effectively compensating the pixel current of the pixel circuit, the structure design of the pixel circuit and the driving method of the pixel circuit should be improved, so as to avoid abnormal display or compensation invalidation in the operation of the OLED display.

SUMMARY

Accordingly, the present invention is directed to a pixel circuit, which can avoid abnormal display or compensation invalidation.

The present invention further is directed to a pixel driving method, which can avoid abnormal display or compensation invalidation.

In an embodiment of the present invention, a pixel circuit includes an OLED, a storage capacitor having a first terminal and a second terminal, a driving transistor, and first through fourth switching transistors. The driving transistor is for driving the OLED, a source electrode of the driving transistor is electrically coupled to the first terminal of the storage capacitor, and a drain electrode of the driving transistor is electrically coupled to the OLED. A gate electrode of the first switching transistor is electrically coupled to a first scanning line, a source electrode of the first switching transistor is electrically coupled to the gate electrode of the driving transistor, and a drain electrode of the first switching transistor is electrically coupled to a data line. A gate electrode of the second switching transistor is electrically coupled to a first scanning line, a source electrode of the second switching transistor is electrically coupled to a first predetermined voltage, and a drain electrode of the second switching transistor is electrically coupled to the first terminal of the storage capacitor. A gate electrode of the third switching transistor is electrically coupled to a second scanning line, a source electrode of the third switching transistor is electrically coupled to a second predetermined voltage and a drain electrode of the third switching transistor is electrically coupled to the second terminal of the storage capacitor. A gate electrode of the fourth switching transistor is electrically coupled to the second scanning line, a source electrode of the fourth switching transistor is electrically coupled to the gate electrode of the driving transistor, and the second source/drain electrode of the fourth switching transistor is electrically coupled to the second terminal of the storage capacitor. Moreover, a gate-on voltage of the first switching transistor and another gate-on voltage of the second switching transistor are in opposite phases. A gate-on voltage of the third switching transistor and another gate-on voltage of the fourth switching transistor are in opposite phases.

In an embodiment of the present invention, the first switching transistor is an N-channel transistor, and the second switching transistor is a P-channel transistor. In addition, the third switching transistor is a P-channel transistor, and the fourth switching transistor is an N-channel transistor.

In another embodiment of the present invention, a pixel driving method is adapted for applying an active matrix OLED display. The active matrix OLED display includes a data line, a first pixel and a second pixel. The first pixel and the second pixel are electrically coupled to the data line. Each of the first and second pixels includes an OLED, a storage capacitor, a driving transistor and a first switching transistor. The driving transistor is used for driving the OLED. A source electrode of the driving transistor is electrically coupled to a first terminal of the storage capacitor, a drain electrode of the driving transistor is electrically coupled to the OLED, and a gate electrode of the driving transistor is electrically coupled to a source electrode of the first switching transistor. A drain electrode of the first switching transistor is electrically coupled to the data line. In addition, the pixel driving method is used for sequentially driving the first pixel and the second pixel, and during driving each of the first and second pixels includes the following steps of: (a) in a resetting stage, supplying a first predetermined voltage to the first terminal of the storage capacitor, and supplying a second predetermined voltage to a second terminal of the storage capacitor; (b) in a writing stage, switching on the first switching transistor to allow a data voltage on the data line to be supplied to the gate electrode of the driving transistor through the first switching transistor, discharging the first terminal of the storage capacitor through the driving transistor and the OLED, and keeping the voltage of the second terminal of the storage capacitor at the second predetermined voltage; and (c) in a light emission stage, supplying the first predetermined voltage again to the first terminal of the storage capacitor, switching off the first switching transistor, enabling the second terminal of the storage capacitor to be electrically communicated with the gate electrode of the driving transistor, and thereby the OLED is driven by the driving transistor. Moreover, the data voltage on the data line occurs a transient in a time period starting from the time of the first switching transistor of the first pixel being switched-off in the writing stage to the time of the first switching transistor of the second pixel being switched on in the writing stage.

In an embodiment of the present invention, when each of the first and second pixels further includes a second switching transistor and a third switching transistor, the second switching transistor is electrically coupled between the first predetermined voltage and the first terminal of the storage capacitor, the third switching transistor is electrically coupled between the second predetermined voltage and the second terminal of the storage capacitor, in the resetting stage, the step of supplying the first predetermined voltage to the first terminal of the storage capacitor and supplying the second predetermined voltage to the second terminal of the storage capacitor includes: switching off the first switching transistor, and switching on both the second switching transistor and the third switching transistor. Furthermore, the first and second switching transistors are controlled by the same control signal.

In an embodiment of the present invention, in the light emission stage, the step of supplying the first predetermined voltage again to the first terminal of the storage capacitor, switching off the first switching transistor, enabling the second terminal of the storage capacitor to be electrically communicated with the gate electrode of the driving transistor and thereby the OLED is driven by the driving transistor includes: switching off the first switching transistor, switching on the second switching transistor, switching off the third switching transistor and switching on the fourth switching transistor.

In an embodiment of the present invention, before the writing stage, the pixel driving method further includes a step of: enabling the data driving circuit so that the data voltage is supplied to the data line.

In still another embodiment of the present invention, another pixel driving method is adapted for applying an active matrix OLED display. The active matrix OLED display includes a data line, a first pixel and a second pixel. The first pixel and the second pixel are electrically coupled to the data line. Each of the first and second pixels includes an OLED, a storage capacitor, a driving transistor and a first switching transistor. The driving transistor is used for driving the OLED. A source electrode of the driving transistor is electrically coupled to a first terminal of the storage capacitor, a drain electrode of the driving transistor is electrically coupled to the OLED, a gate electrode of the driving transistor is electrically coupled to a source electrode of the first switching transistor, and a drain electrode of the first switching transistor is electrically coupled to the data line. The pixel driving method herein is used for driving the first and second pixels in turn, and during driving each of the first and second pixels includes the following steps of: (I) in a resetting stage, supplying a first predetermined voltage to the first terminal of the storage capacitor, and supplying a second predetermined voltage to a second terminal of the storage capacitor; (II) in a writing stage, enabling the data line to supply a data voltage to the gate electrode of the driving transistor through the first switching transistor, discharging the first terminal of the storage capacitor through the driving transistor and the OLED, and keeping the voltage of the second terminal of the storage capacitor at the second predetermined voltage; and (III) in a light emission stage, supplying the first predetermined voltage again to the first terminal of the storage capacitor, switching off the first switching transistor, enabling the second terminal of the storage capacitor to be electrically communicated with the gate electrode of the driving transistor and thereby the OLED is driven by the driving transistor. Moreover, during driving the second pixel, the method further includes steps of: in the writhing stage, before enabling the data line to supply the data voltage to the gate electrode of the driving transistor through the first switching transistor. The precharge voltage is supplied to the data line in a time period starting from the time of the first switching transistor of the first pixel being switched-off in the writing stage to the first switching transistor of the second pixel being switched on in the writing stage. The precharge voltage is larger than the sum of the data voltage supplied to the gate electrode of the driving transistor of the second pixel and the threshold voltage of the driving transistor of the second pixel.

In an embodiment of the present invention, when each of the first and second pixels further includes a second switching transistor and a third switching transistor, the second switching transistor is electrically coupled between the first predetermined voltage and the first terminal of the storage capacitor, the third switching transistor is electrically coupled between the second predetermined voltage and the second terminal of the storage capacitor, in the resetting stage, the step of supplying a first predetermined voltage to the first terminal of the storage capacitor and supplying the second predetermined voltage to the second terminal of the storage capacitor includes: switching off the first switching transistor, and switching on both the second switching transistor and the third switching transistor. Furthermore, the first and second switching transistors are controlled by the same control signal.

In an embodiment of the present invention, when each of the first and second pixels even further includes a fourth switching transistor electrically coupled between the second terminal of the storage capacitor and the gate electrode of the driving transistor, in the writing stage, the step of enabling the data line to supply the data voltage to the gate electrode of the driving transistor through the first switching transistor, discharging the first terminal of the storage capacitor through the driving transistor and the OLED, and keeping the voltage of the second terminal of the storage capacitor at the second predetermined voltage includes: switching on the first switching transistor, switching off the second switching transistor, maintaining the third switching transistor at switched on state and the fourth switching transistor at switched off state. Furthermore, the third and fourth switching transistors are controlled by the same control signal.

In an embodiment of the present invention, in the light emission stage, the step of supplying the first predetermined voltage again to the first terminal of the storage capacitor, switching off the first switching transistor, enabling the second terminal of the storage capacitor to be electrically communicated with the gate electrode of the driving transistor and thereby the OLED is driven by the driving transistor includes: switching off the first switching transistor, switching on the second switching transistor, switching off the third switching transistor and switching on the fourth switching transistor.

In an embodiment of the present invention, when the active matrix OLED display further includes a demultiplexer, and the data line is electrically coupled to an output terminal of the demultiplexer, during driving the second pixel, the pixel driving method further includes steps of: enabling the demultiplexer, so that the precharge voltage is supplied to the data line through the demultiplexer; and enabling the demultiplexer again, so that the precharge voltage of the data line is changed to be the data voltage.

The above-mentioned embodiments of present invention propose a special design of the pixel circuit and the pixel driving method, so that in the resetting stage of the pixel driving method, the date voltage on the data line cannot be coupled to the gate electrode of the driving transistor; and in the writing stage, the potential on the terminal of the storage capacitor and coupled to the driving transistor can be normally discharged to a required voltage value. Therefore, the pixel current of the pixel circuit can be effectively compensated, and the problems of abnormal display and/or compensation invalidation associated with the prior art are consequently solved.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
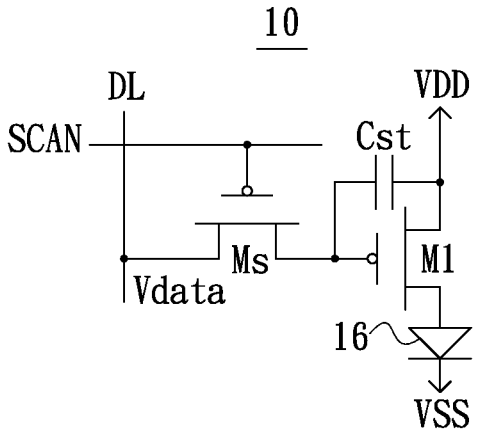
FIG. 1 (Related Art)
FIG. 1 is a schematic view of a traditional pixel circuit.
Figure 2:
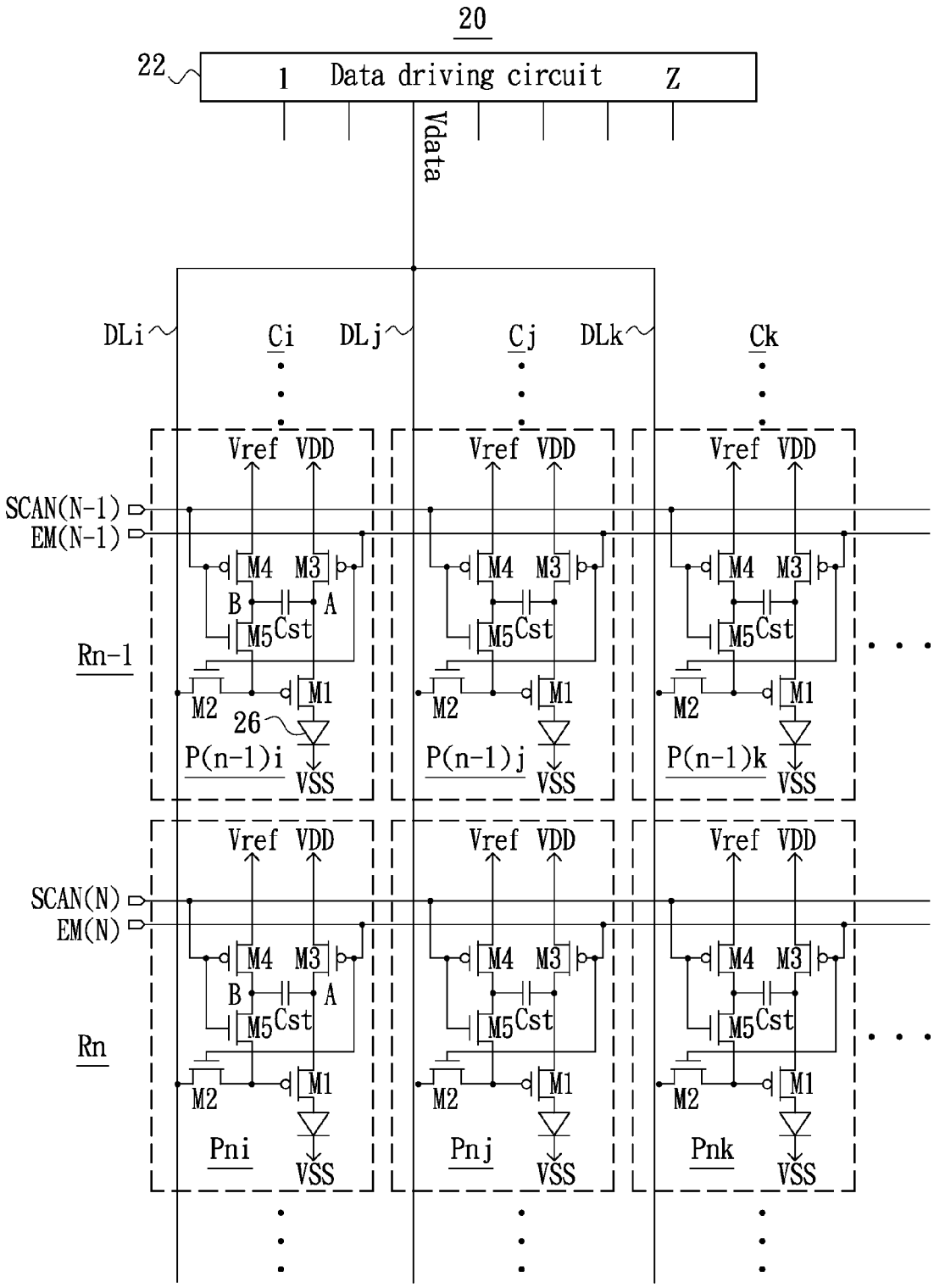
FIG. 2 is a schematic partial structural diagram of an active matrix OLED display according to a first embodiment of the present invention.
Figure 3:
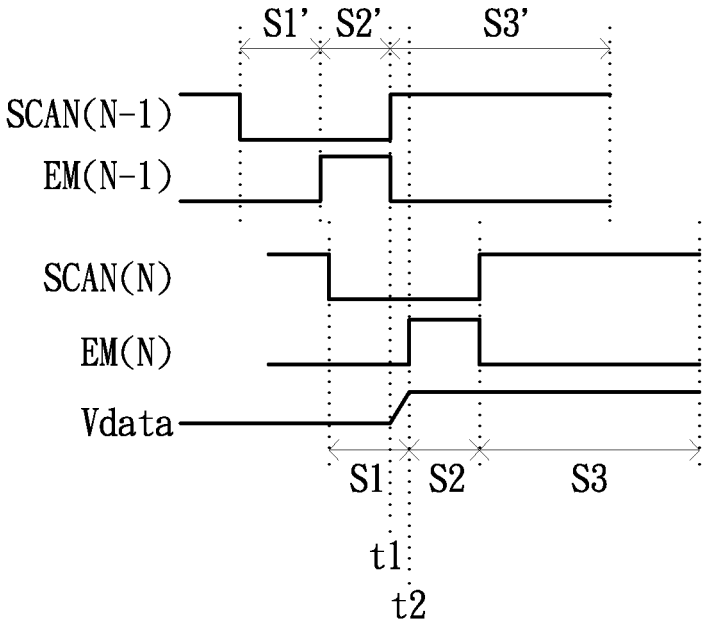
FIG. 3 is a timing diagram of scanning signals and a data voltage associated with a pixel driving method according to the first embodiment of the present invention.

Referring to FIGS. 2 and 3, FIG. 2 illustrates a schematic partial structural diagram of an active matrix organic light emitting diode (OLED) display in accordance with a first embodiment of the present invention, and FIG. 3 illustrates a timing diagram of scanning signals and a data voltage associated with a pixel driving method in accordance with the first embodiment of the present invention.

As shown in FIG. 2, the active matrix OLED display 20 includes a data driving circuit 22, data lines DLi~DLk, scanning lines SCAN(N−1) and SCAN(N), scanning lines EM(N−1) and EM(N), and a plurality of pixel circuits P(n−1)i~P(n−1)k and Pni~Pnk. Each of the pixel circuits P(n−1)i~P(n−1)k and Pni~Pnk is electrically coupled to one of the scanning lines SCAN(N−1) and SCAN(N), one of the scanning lines EM(N−1) and EM(N), and one of the data lines DLi~DLk. The plurality of pixel circuits P(n−1)i~P(n−1)k and Pni~Pnk are arranged in pixel rows Rn−1, Rn, and pixel columns Ci~Ck in a matrix manner. The data driving circuit 22 is used for supplying a data voltage Vdata. The data driving circuit 22 has a plurality of output terminals 1-Z. Each of the data lines DLi~DLk is electrically coupled to one of the terminals 1-Z of the data driving circuit 22 for obtaining the data voltage Vdata.

Moreover, each of the pixel circuits P(n−1)i~P(n−1)k and Pni~Pnk has a structure of 5T1C (five transistors and one capacitor). For example, the pixel circuit P(n−1)i includes an OLED 26, a storage capacitor Cst, a P-channel driving transistor M1, N-channel switching transistors M2 and M5, and P-channel switching transistors M3 and M4. The driving transistor M1 is used for driving the OLED 26 at a predetermined brightness. The source electrode of the driving transistor M1 is electrically coupled to a terminal A of the storage capacitor Cst, the drain electrode of the driving transistor M1 is electrically coupled to the anode of the OLED 26, and the cathode of the OLED 26 is electrically coupled to the power supply voltage VSS. The source electrode of switching transistor M2 is electrically coupled to the gate electrode of the driving transistor M1, the drain electrode of the switching transistor M2 is electrically coupled to the data line DLi, and the gate electrode of the switching transistor M2 is electrically coupled to the scanning line EM(N−1) for receiving ascanning signal. The source electrode of switching transistor M3 is electrically coupled to the power supply voltage VDD, the drain electrode of the switching transistor M3 is electrically coupled to the terminal A of the storage capacitor Cst, and the gate electrode of the switching transistor M3 is electrically coupled to the scanning line EM(N−1) for receiving the scanning signal. The source electrode of switching transistor M4 is electrically coupled to a reference voltage Vref, the drain electrode of the switching transistor M4 is electrically coupled to a terminal B of the storage capacitor Cst, and the gate electrode of the switching transistor M4 is electrically coupled to the scanning line SCAN(N−1) for receiving a scanning signal. The source electrode of switching transistor M5 is electrically coupled to the gate electrode of the driving transistor M1, the drain electrode of the switching transistor M5 is electrically coupled to the terminal B of the storage capacitor Cst, and the gate electrode of the switching transistor M5 is electrically coupled to the scanning line SCAN(N−1) for receiving the scanning signal. Furthermore, as seen from FIGS. 2 and 3, the gate electrodes of the switching transistors M2 and M3 are electrically coupled to each other. The gate-on voltages of the switching transistors M2 and M3 are in opposite phases with respect to each other, and on-off states of the switching transistors M2 and M3 are determined by the same control signal.

Still referring to FIGS. 2 and 3 together, a pixel driving method of the active matrix OLED display 20 will be described in detail as follows. It only takes a process of driving pixel circuits P(n−1)i and Pni in turn as an example in following description. As seen from FIG. 3, the process of driving the pixel circuit P(n−1)i includes a resetting stage S1', a writing stage S2' and a light emission stage S3'. Similarly, the process of driving the pixel circuit Pni includes a resetting stage S1, a writing stage S2 and a light emission stage S3.

Specifically, in the resetting stage S1', SCAN(N−1) and EM(N−1) are both at logic low level. At this time, the switching transistors M3 and M4 are at switched-on state, and the switching transistors M2 and M5 are at switched-off state. The power supply voltage VDD and the reference voltage Vref are respectively supplied to the terminals A and B of the storage capacitor Cst through the respective switching transistors M3 and M4. Due to the switching transistor M2 is at switched-off state, the data voltage Vdata on the data line DLi would not be transmitted to the gate electrode of the driving transistor M1.

In the writing stage S2', SCAN(N−1) is at logical low level and EM(N−1) is at logic high level. At this time, the switching transistors M2 and M4 are at switched-on state, and the switching transistors M3 and M5 are at switched-off state. Due to the switching transistor M2 is at switched-on state, the data voltage Vdata of the data line DLi is transmitted to the gate electrode of the driving transistor M1. A potential at the terminal A of the storage capacitor Cst is discharged to be (Vdata+|Vth1|) from VDD through both the driving transistor M1 and the OLED 26. Due to the switching transistor M4 is at switched-on state, a potential at the terminal B of the storage capacitor Cst keeps at Vref. Where, |Vth1| is the threshold voltage of the driving transistor M1. The data voltages Vdata required by the pixel circuit P(n−1)i and Pni are respectively supplied to the data line DLi before the respective writing stages S2 and S2'.

In the light emission stage S3', SCAN(N−1) is at logic high level, and EM(N−1) is at logic low level. At this time, the switching transistors M3 and M5 are at switched-on state, and the switching transistors M2 and M4 are at switched-off state. The power supply voltage VDD is supplied to the terminal A of the capacitor Cst again through the switching transistor M3. Due to the switching transistor M5 is at switched-on state, the terminal B of the storage capacitor Cst and the gate electrode of the driving transistor M1 are electrically communicated with each other, and thereby the driving transistor M1 generates a pixel current according to the amount of the charge stored in the storage capacitor Cst to drive the OLED element 26 at a predetermined brightness. It is noted that the process of driving the pixel circuit Pni is similar to the process of driving the pixel circuit P(n−1)i and will not described redundantly.

In addition, as seen from FIG. 3, the data voltage Vdata on the data line DLi occurs a transient, e.g., changing from a logic low level to a logic high level, in a time period starting from the time t1 of the switching transistor M2 of the pixel circuit P(n−1)i being switched-off after the writing phase S2' until the time t2 of just before the switching transistor M2 of the pixel circuit Pni being switched on in the writing stage S2.

Herein, since the data voltage Vdata is changed to be Vdata (n) (corresponding to the data voltage written into the pixel circuit Pni) before the writing stage S2 of the pixel circuit Pni, the potential at the terminal A of the storage capacitor Cst (i.e., the potential at the source electrode of the driving transistor M1) can be normally changed from VDD to (Vdata(n)+|Vth1|). Therefore, the problem of abnormal display or compensation invalidation associated with prior art can be effectively solved.

Figure 4:
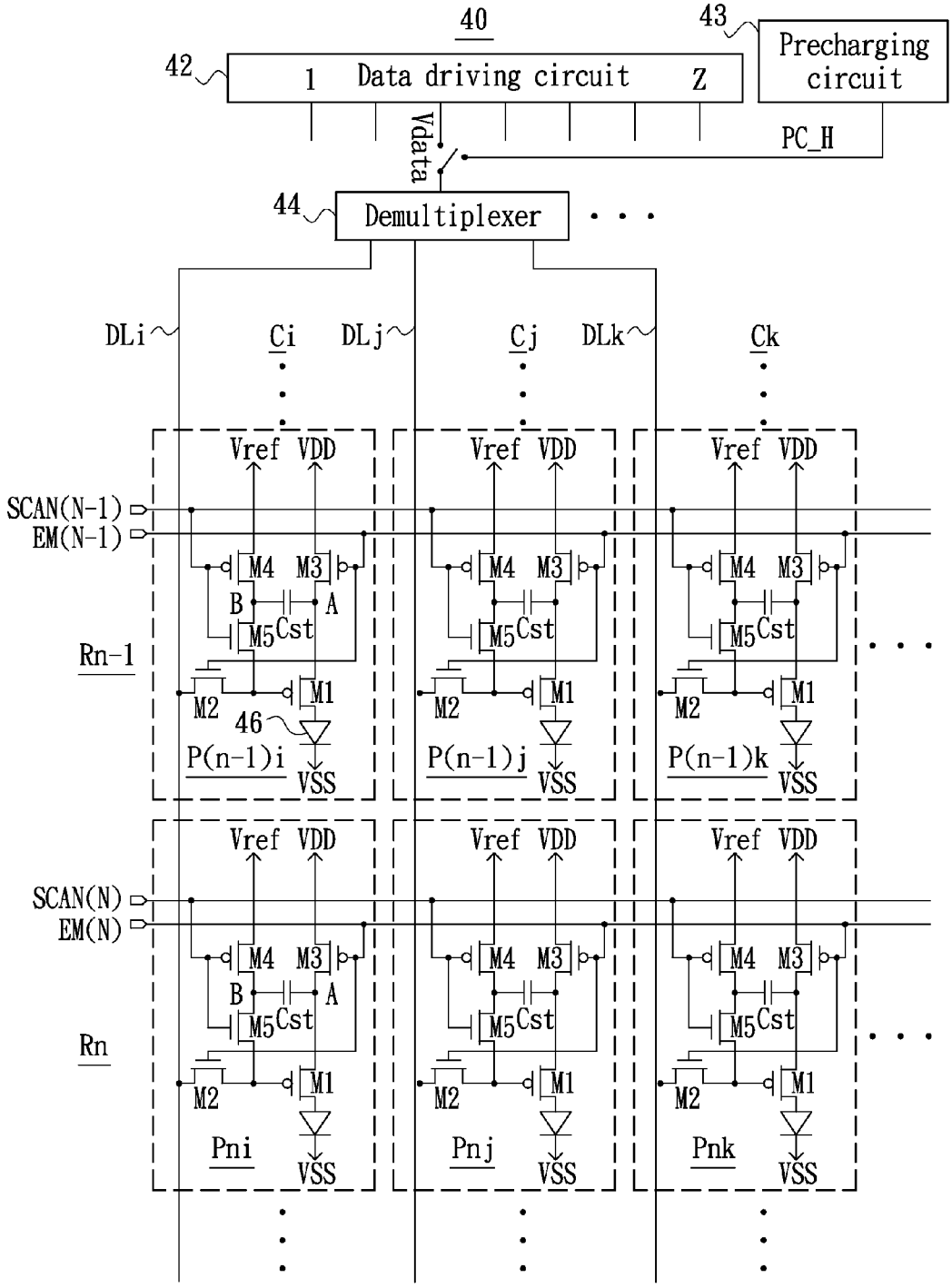
FIG. 4 is a schematic partial structural diagram of an active matrix OLED display according to a second embodiment of the present invention.
Figure 5:
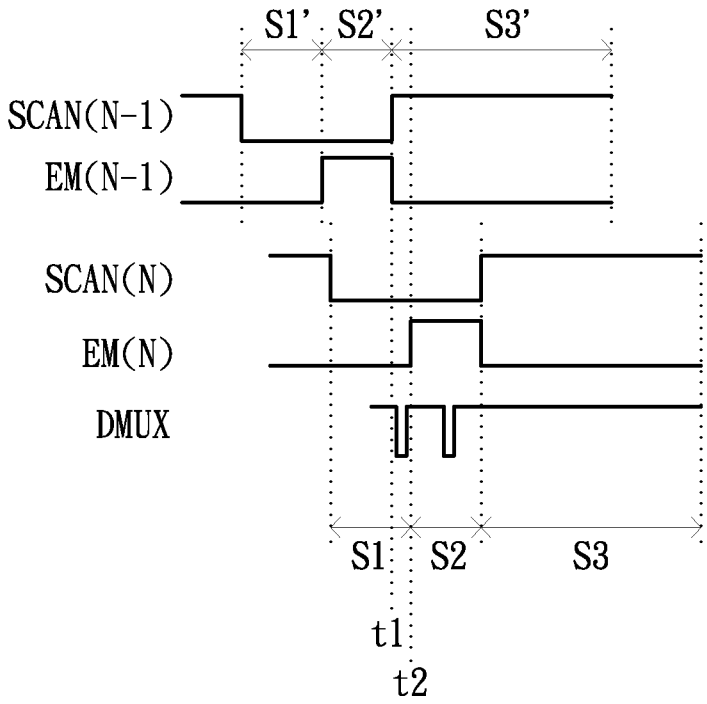
FIG. 5 is a timing diagram of scanning signals and a control signal of demultiplexer associated with a pixel driving method according to the second embodiment of the present invention.

Referring to FIGS. 4 and 5, FIG. 4 showing a schematic partial structural diagram of an active matrix OLED display in accordance with a second embodiment of the present invention, and FIG. 5 showing a timing diagram of scanning signals and a control signal (DMUX) of demultiplexer associated with a pixel driving method in accordance with the second embodiment of the present invention.

As illustrated in FIG. 4, the active matrix OLED display 40 includes a data driving circuit 42, a precharging circuit 43, a demultiplexer 44, data lines DLi~DLk, scanning lines SCAN (N−1) and SCAN(N), scanning lines EM(N−1) and EM(N), and a plurality of pixel circuits P(n−1)i~P(n−1)k and Pni~Pnk. Each of the pixel circuits P(n−1)i~P(n−1)k and Pni~Pnk is electrically coupled to the respective scanning lines Scan(N−1) and Scan(N), scanning lines EM(N−1) and EM(N) and data lines DLi~DLk. The plurality of pixel circuits P(n−1)i~P(n−1)k and Pni~Pnk are arranged in pixel rows Rn−1, Rn and pixel columns Ci~Ck in a matrix manner. The data driving circuit 42 is used for supplying a data voltage Vdata. The data driving circuit 22 has a plurality of output terminals 1~Z. The precharging circuit 43 is used for supplying a precharge voltage PC_H. Each of the data lines DLi~DLk is electrically coupled to one of the output terminals 1~Z of the data driving circuit 12 and the precharging circuit 43 through the demultiplexer 14 and for selectively obtaining the data voltage Vdata and the precharge voltage PC_H.

Moreover, each of the pixel circuits P(n−1)i~P(n−1)k and Pni~Pnk has a structure of 5T1C. For example, the pixel circuit P(n−1)i includes an OLED 46, a storage capacitor Cst, a P-channel driving transistor M1, N-channel switching transistors M2 and M5, and P-channel transistors M3 and M4. The driving transistor M1 is used for driving the OLED 46 at a predetermined brightness. The source electrode of the driving transistor M1 is electrically coupled to the terminal A of the storage capacitor Cst, and the drain electrode of the driving transistor M1 is electrically coupled to the anode of the OLED 46. The cathode of the OLED 46 is electrically coupled to the power supply voltage VSS. The source electrode of switching transistor M2 is electrically coupled to the gate electrode of the driving transistor M1, the drain electrode of the switching transistor M2 is electrically coupled to the data line DLi, and the gate electrode of the switching transistor M2 is electrically coupled to the scanning line EM(N−1) for receive a scanning signal. The source electrode of switching transistor M3 is electrically coupled to the power supply voltage VDD, the drain electrode of the switching transistor M3 is electrically coupled to the terminal A of the storage capacitor Cst, and the gate electrode of the switching transistor M3 is electrically coupled to the scanning line EM(N−1) for receiving the scanning signal. The source electrode of switching transistor M4 is electrically coupled to a reference voltage Vref, the drain electrode of the switching transistor M4 is electrically coupled to a terminal B of the storage capacitor Cst, and the gate electrode of the switching transistor M4 is electrically coupled to the scanning line SCAN(N−1) for receiving a scanning signal. The source electrode of switching transistor M5 is electrically coupled to the gate electrode of the driving transistor M1, the drain electrode of the switching transistor M5 is electrically coupled to the terminal B of the storage capacitor Cst, and the gate electrode of the switching transistor M5 is electrically coupled to the scanning line SCAN(N−1) for receiving the scanning signal. Furthermore, as seen from FIGS. 4 and 5, the gate electrodes of the switching transistors M2 and M3 are electrically coupled to each other. The gate-on voltages of the switching transistors M2 and M3 are in opposite phases with respect to each other, and on-off states of the switching transistors M2 and M3 are determined by the same control signal.

Still referring to FIGS. 4 and 5 together, a pixel driving method of the active matrix OLED display 40 will be described in detail as follows. It only takes a process of driving pixel circuits P(n−1)i and Pni in turn as an example in the following description. It is founded from FIG. 5, the process of driving the pixel circuit P(n−1)i includes a resetting stage 51', a writing stage S2' and a light emission stage S3'. Similarly, the process of driving the pixel circuit Pni includes a resetting stage S1, a writing stage S2 and a light emission stage S3.

Specifically, in the resetting stage S1', SCAN(N−1) and EM(N−1) are both at logic low level. At this time, the switching transistors M3 and M4 are at switched-on state, and the switching transistors M2 and M5 are at switched-off state. The power supply voltage VDD and the reference voltage Vref are respectively supplied to the terminals A and B of the storage capacitor Cst through the respective switching transistors M3 and M4. Since the switching transistor M2 is at switched-off state, the data voltage Vdata on the data line DLi would not be transmitted to the gate electrode of the driving transistor M1.

In the writing stage S2', SCAN(N−1) is at logic low level, and EM(N−1) is at logic high level. At this time, the switching transistors M2 and M4 are at switched-on state, and the switching transistors M3 and M5 are at switched-off state. The data line DLi supplies a precharge voltage PC_H to the gate electrode of the driving transistor M1 through the switching transistor M2. A potential at the terminal A of the storage capacitor Cst is discharged to be (PC_H+|Vth1|) from VDD through both the driving transistor M1 and the OLED 46. Thereafter, when the precharge voltage PC_H of the data line DLi is changed to be the data voltage Vdata, the data line DLi then supplies the data voltage Vdata to the gate electrode of the driving transistor M1 through the switching transistor M2, on the potential at the terminal A of the storage capacitor Cst continue to discharge to be (Vdata+|Vth1|) from (PC_H+|Vth1|) through both the driving transistor M1 and the OLED 46. Due to the switching transistor M4 is at switched-on state, on the potential at the terminal B of the storage capacitor Cst keeps at Vref. Where, Vth1 is the threshold voltage of the driving transistor M1. The precharge voltages PC_H and the data voltages Vdata required by the respective pixel circuits P(n−1)i and Pni are supplied to the data line DLi in turn by enabling the demultiplexer 44 twice.

More specifically, in the process of driving the pixel circuit Pni, the precharge voltage PC_H is provided to the data line DLi in a time period starting from the time t1 of the switching transistor M2 of the pixel circuit P(n−1)i being switched-off after the writing phase S2' until the time/moment t2 just before the switching transistor M2 of the pixel circuit Pni being switched on in the writing stage S2. An amplitude of the precharge PC_H is larger than the sum of the data voltage Vdata(n) on the gate electrode of the driving transistor M1 of the pixel circuit Pni and the threshold voltage |Vth1| of the driving transistor M1 of the pixel circuit Pni. Herein, due to the supply of the precharge voltage PC_H, the potential at the terminal A of the storage capacitor Cst (i.e., the potential at the source electrode of the driving transistor M1) can be normally changed from VDD to (Vdata(n)+|Vth1|). Therefore, the problem of abnormal display or compensation invalidation associated with prior art can be effectively solved.

In the light emission stage S3', SCAN(N−1) is at logic high level, and EM(N−1) is at logic low level. At this time, the switching transistors M3 and M5 are at switched-on state, and the switching transistors M2 and M4 are at switched-off state. The power supply voltage VDD is supplied to the terminal A of the capacitor Cst again through the switching transistor M3. Due to the switching transistor M5 is at switched-on state, the terminal B of the storage capacitor Cst and the gate electrode of the driving transistor M1 are electrically communicated with each other, and thereby the driving transistor M1 generates a pixel current according to the amount of the charge stored in the storage capacitor Cst to drive the OLED element 46 at a predetermined brightness. It is noted that the process of driving the pixel circuit Pni is similar to the process of driving the pixel circuit P(n−1)i and will not described redundantly.

As stated above, the above-mentioned embodiments of present invention employ a special design of the pixel circuit and the pixel driving method, so that in the resetting stage of the pixel driving method, the date voltage on the data line would not be coupled to the gate electrode of the driving transistor; and in the writing stage, the potential at the terminal of the storage capacitor and coupled to the driving transistor can be normally discharged to a required voltage. Therefore, the pixel current of the pixel circuit can be effectively compensated, and the problems of abnormal display and/or compensation invalidation associated with the prior art consequently are solved.

Additional, one skilled in the art could devise variations the pixel circuit, the pixel driving method and the active matrix OLED display using the same. For example, changing the number/amount of the transistors in the pixel circuit, changing the pixel number in the active matrix OLED display, the type of each transistor (P-channel or N-channel), exchanging the connection of the source and drain electrodes of each transistor, and so on.

The above description is given by way of example, and not limitation. Given the above disclosure, one skilled in the art could devise variations that are within the scope and spirit of the invention disclosed herein, including configurations ways of the recessed portions and materials and/or designs of the attaching structures. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A pixel driving method of an active matrix organic light emitting diode (OLED) display, wherein the active matrix OLED display comprises a data line, a first pixel and a second pixel, the first pixel and the second pixel being electrically coupled to the data line, each of the first pixel and the second pixel comprising an OLED, a storage capacitor, a driving transistor and a first switching transistor, the driving transistor being used for driving the OLED, a source electrode of the driving transistor being electrically coupled to a first terminal of the storage capacitor, a drain electrode of the driving transistor being electrically coupled to the OLED, a gate electrode of the driving transistor being electrically coupled to a source electrode of the first switching transistor, a drain electrode of the first switching transistor being electrically coupled to the data line; the pixel driving method being adapted for sequentially driving the first pixel and the second pixel, and during driving each of the first pixel and the second pixel comprising the steps of:

in a resetting stage, supplying a first predetermined voltage to the first terminal of the storage capacitor, and supplying a second predetermined voltage to a second terminal of the storage capacitor;

in a writing stage, enabling the data line to supply a data voltage to the gate electrode of the driving transistor through the first switching transistor, discharging the first terminal of the storage capacitor through the driving transistor and the OLED, and keeping the voltage of the second terminal of the storage capacitor at the second predetermined voltage; and in a light emission stage, supplying the first predetermined voltage again to the first terminal of the storage capacitor, switching off the first switching transistor, enabling the second terminal of the storage capacitor to be electrically communicated with the gate electrode of the driving transistor, and thereby the OLED is driven by the driving transistor;

wherein during driving the second pixel, the pixel driving method further comprises the steps of: in the writing stage, before enabling the data line to supply the data voltage to the gate electrode of the driving transistor through the first switching transistor, enabling the data line to supply a precharge voltage to the gate electrode of the driving transistor through the first switching transistor, wherein the precharge voltage is supplied on the data line in a time period starting from the time of the first switching transistor of the first pixel being switched off in the writing stage to the time of the first switching transistor of the second pixel being switched on in the writing stage, and the precharge voltage is larger than the sum of the data voltage on the gate electrode of the driving transistor of the second pixel and the threshold voltage of the driving transistor of the second pixel.

2. The pixel driving method as claimed in claim 1, wherein when each of the first pixel and the second pixel further comprises a second switching transistor and a third switching transistor, the second switching transistor being electrically coupled between the first predetermined voltage and the first terminal of the storage capacitor, the third switching transistor being electrically coupled between the second predetermined voltage and the second terminal of the storage capacitor, in the resetting stage, the step of supplying the first predetermined voltage to the first terminal of the storage capacitor and supplying the second predetermined voltage to the second terminal of the storage capacitor comprises:

switching off the first switching transistor, and switching on the second switching transistor and the third switching transistor.

3. The pixel driving method as claimed in claim 2, wherein the first and second switching transistors are controlled by the same control signal.

4. The pixel driving method as claimed in claim 2, wherein when each of the first pixel and the second pixel further comprises a fourth switching transistor electrically coupled between the second terminal of the storage capacitor and the gate electrode of the driving transistor, in the writing stage, the step of enabling the data line to supply the data voltage to the gate electrode of the driving transistor through the first switching transistor, discharging the first terminal of the storage capacitor through the driving transistor and the OLED, and keeping the voltage of the second terminal of the storage capacitor at the second predetermined voltage comprises:

switching on the first switching transistor, switching off the second switching transistor, switching on the third switching transistor, and switching off the fourth switching transistor.

5. The pixel driving method as claimed in claim 4, wherein the third and fourth switching transistors are controlled by the same control signal.

6. The pixel driving method as claimed in claim 4, wherein in the light emission stage, the step of supplying the first predetermined voltage again to the first terminal of the storage capacitor, switching off the first switching transistor, enabling the second terminal of the storage capacitor to be electrically communicated with the gate electrode of the driving transistor, and thereby the OLED is driven by the driving transistor comprises:

switching off the first switching transistor, switching on the second switching transistor, switching off the third switching transistor and switching on the fourth switching transistor.

7. The pixel driving method as claimed in claim 1, wherein when the active matrix OLED display further comprises a demultiplexer, and the data line is electrically coupled to an output terminal of the demultiplexer, during driving the second pixel, the pixel driving method further comprises steps of:

enabling the demultiplexer and thereby the precharge voltage is supplied to the data line through the demultiplexer; and enabling the demultiplexer again and thereby the precharge voltage of the data line is changed to be the data voltage.

* * * * *